US005746510A

United States Patent [19]

Mark et al.

[11] Patent Number: 5,746,510

[45] Date of Patent: May 5, 1998

[54] MIXING DEVICE INCLUDING COUNTERWEIGHT

[75] Inventors: Fritz Mark, Maeder, Austria; Martin Noser, Vaduz, Liechtenstein

[73] Assignee: Friedhelm Schneider, Reichshof-Hahn, Germany

[21] Appl. No.: 809,858

[22] PCT Filed: Dec. 1, 1995

[86] PCT No.: PCT/EP95/04747

§ 371 Date: Apr. 2, 1997

§ 102(e) Date: Apr. 2, 1997

[87] PCT Pub. No.: WO96/17677

PCT Pub. Date: Jun. 13, 1996

[30] Foreign Application Priority Data

Dec. 3, 1994 [DE] Germany ..... 44 43 140.6

[51] Int. Cl.[6] ..... B01F 9/02

[52] U.S. Cl. ..... 366/217

[58] Field of Search ..... 366/54, 55, 62, 366/63, 91–93, 208, 209, 213, 214, 217, 219, 220, 235, 605; 494/19, 33

[56] References Cited

U.S. PATENT DOCUMENTS

| | | | |
|---|---|---|---|
| 1,011,929 | 12/1911 | Ecaubert | 366/213 X |
| 3,199,775 | 8/1965 | Drucker . | |
| 3,235,173 | 2/1966 | Unger | 494/19 X |
| 3,778,033 | 12/1973 | Pullman | 366/219 |
| 4,235,553 | 11/1980 | Gall | 366/208 |
| 4,497,581 | 2/1985 | Miller . | |
| 4,728,197 | 3/1988 | Reinhard | 366/219 |
| 5,167,448 | 12/1992 | Herold et al. | 366/217 X |
| 5,352,037 | 10/1994 | Jouvin | 366/219 |
| 5,551,779 | 9/1996 | Gantner et al. | 366/217 |

FOREIGN PATENT DOCUMENTS

| | | | |
|---|---|---|---|
| 2001301 | 7/1970 | Germany . | |
| 2209850 | 10/1972 | Germany . | |
| 4239284 | 5/1994 | Germany . | |
| 59-105826 | 6/1984 | Japan . | |
| 1472109 | 4/1989 | U.S.S.R. | 366/217 |

*Primary Examiner*—Charles E. Cooley
*Attorney, Agent, or Firm*—Spencer & Frank

[57] ABSTRACT

A mixing device for mixing free flowing masses in a container includes: a rotating carrier defining a mixing side, a balancing side disposed opposite the mixing side, and a direction of rotation about the rotational axis of the mixing device; a container carrier for carrying the container, the container carrier being disposed on the mixing side of the rotating carrier and further being adapted to rotate counter to the direction of rotation of the rotating carrier; a housing defining a housing center of gravity and being effective as an active balancing weight for the container carrier for balancing moments on the mixing side and on the balancing side; and a counterweight defining a counterweight center of gravity and disposed on the rotating carrier, the counterweight further having a weight matching a tare weight of the housing. The housing and the counterweight are displaceable radially with respect to the rotational axis of the mixing device on the balancing side of the rotating carrier. Additionally, the housing center of gravity and the counterweight center of gravity are located on a common line extending perpendicularly with respect to the rotational axis of the rotating carrier. Moreover, the counterweight and the housing are displaceable counter to one another by an equal distance.

4 Claims, 3 Drawing Sheets

R
9
8
9
7
7
4
S2
5
5
15
S3
6
3
6
S1
SA
S4
1
RA
11
12
10
A

MIXING DEVICE INCLUDING COUNTERWEIGHT

FIELD OF THE INVENTION

The invention relates to a mixing device for mixing free-flowing masses located in a container. The device has a rotating carrier that is provided on a mixing side with a container carrier for the container. The container which rotates counter to the direction of rotation of the carrier. The device is further provided on a balancing side with a housing for an active balancing weight opposite the mixing side, with the moments of the mixing side and the moments of the balancing side being balanced.

BACKGROUND OF THE INVENTION

DE-OS 42 39 284 discloses a mixing device for free-flowing masses that has a carrier, a rotating container carrier for a container holding a free-flowing mass, and a housing. The container carrier can be driven about its own axis, counter to a direction of rotation of the carrier. The housing serves to receive an active balancing weight in the form of a free-flowing medium that is matched to the weight of the container and the weight of the free-flowing mass located in the container.

To mix free-flowing masses having different specific weights, it is necessary to adapt the active balancing weight. In the process, the volume of the balancing weight is decreased or increased, or the active balancing weight, without being changed in volume, is exchanged for another balancing weight having a different specific weight.

SUMMARY OF THE INVENTION

It is the object of the invention to provide a mixing device with which free-flowing masses having different specific weights can be mixed without necessitating a change in volume or an exchange of the active balancing weight.

In accordance with the invention, the object is accomplished with a mixing device in which the housing and a counterweight disposed on the carrier and coinciding in weight with the tare weight of the housing are disposed to be radially displaceable on the balancing side; the center of gravity of the housing and the center of gravity of the counterweight are disposed on a common beam extending perpendicular to the axis of rotation of the carrier, and the counterweight can be displaced, corresponding to the magnitude of displacement of the housing, counter to the direction of displacement of the housing.

To match the active balancing weight disposed in the housing to the weight of the free-flowing mass to be mixed, it is necessary to displace the housing radially with respect to the axis of rotation. Consequently, the position of the center of gravity of the housing changes. At the same time, however, the position of the center of gravity of the counterweight also changes, in the opposite direction, so that the two centers of gravity lie on the same beam. A common center of gravity formed by the housing and the counterweight likewise lies on the beam, specifically between the centers of gravity of the housing and the counterweight, and always maintains its position. This ensures that the masses present on the balancing side and the mixing side are constantly balanced without the weight of the active balancing weight, without the free-flowing mass located in the container and without the container.

Seen strictly in terms of calculation, only the active balancing weight is displaced when the housing is displaced radially.

The housing and the counterweight advisably cooperate with at least one threaded spindle disposed to be fixed both axially and against relative rotation, and to rotate freely, on the carrier, with the threaded region that cooperates with the housing working in the opposite direction with respect to the threaded region that cooperates with the counterweight. With the aid of the threaded spindle disposed on the carrier, the housing and the counterweight can be adjusted simply and quickly. Because of the threaded regions working in opposite directions, the distance of the housing from the axis of rotation of the mixing device and the distance between the housing and the counterweight change when the threaded spindle rotates.

The suspension of the housing and the balancing weight on the carrier of the mixing device is preferably effected by way of four parallel threaded spindles cooperating with the housing and the counterweight. The threaded spindles are uniformly distributed at the periphery of the housing or counterweight, thus achieving a uniform distribution of the rotational forces caused by the housing and the counterweight onto the carrier.

To permit a uniform rotation of all of the threaded spindles and a uniform displacement of the housing and the counterweight, the threaded spindles are usefully connected to one another by way of a transmission element. The threaded spindles are respectively connected in an end region to a drive wheel provided with an outer toothing. All of the drive wheels are connected to one another, so as to be fixed against relative rotation, by way of a transmission element, for example in the form of a chain.

BRIEF DESCRIPTION OF THE DRAWINGS

The invention is described in detail in conjunction with drawings that illustrate an embodiment of the invention. Shown are in.

DETAILED DESCRIPTION OF THE INVENTION

Figure 1:
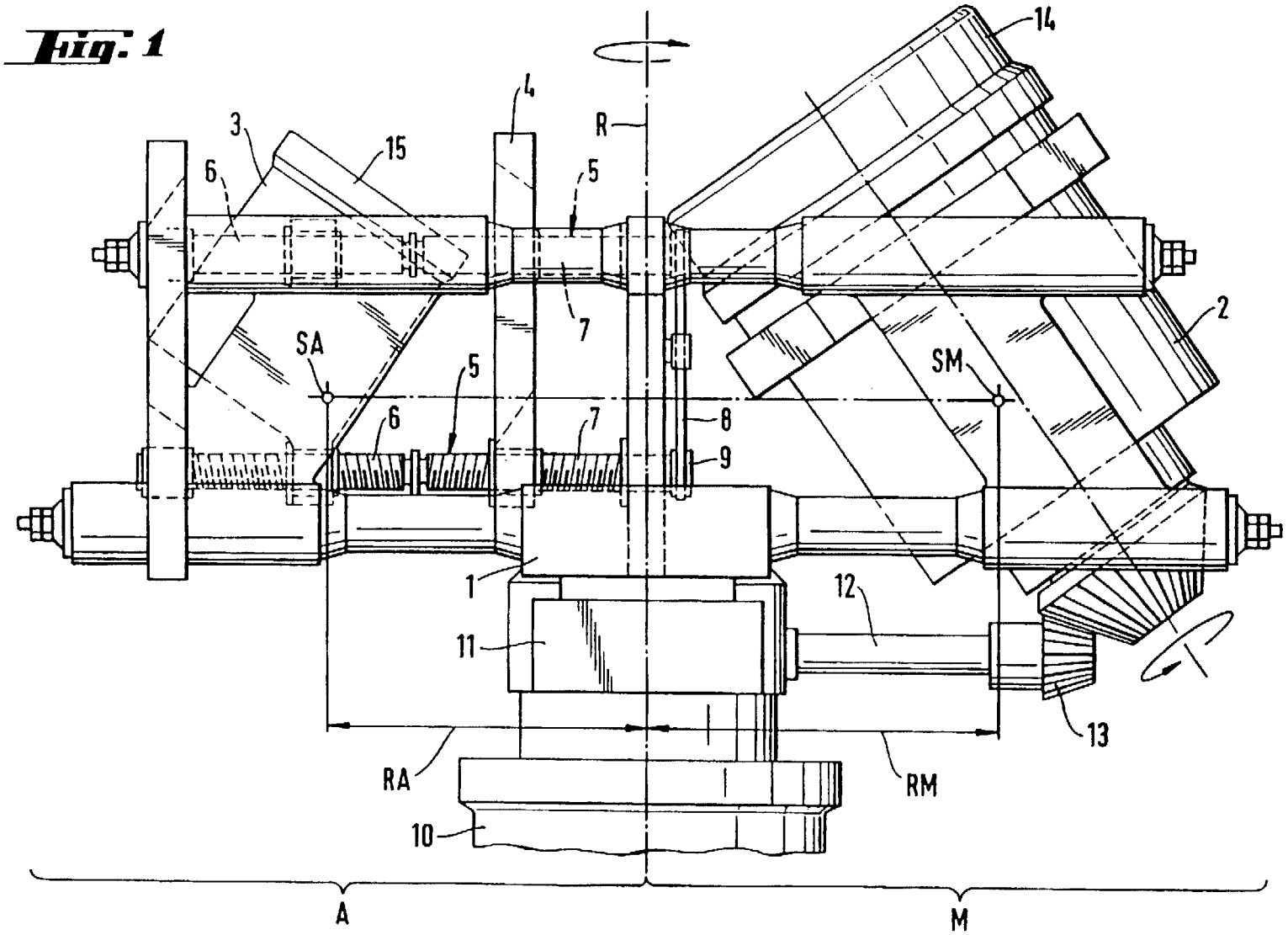
FIG. 1 a side view of a mixing device of the invention.

FIG. 1 shows a mixing device serving to mix free-flowing masses located in a container, comprising a mixing side M and a balancing side A. The container and the free-flowing masses located therein are not shown. A rotating carrier 1 extends across the balancing side A and the mixing side M. A drive motor 10, in connection with a gear 11, serves to drive the carrier 1.

On the mixing side M, the mixing device has a rotating container carrier 2, which is disposed on the carrier 1 and can be driven counter to the direction of rotation of the carrier 1. The container carrier 2 is driven by way of a drive shaft 12 connected to the gear 11 and an angular gear 13 disposed between the container carrier 2 and the drive shaft 12. A lid 14 is detachably disposed on the container carrier 2.

On the balancing side A, the mixing device has a housing 3 that can receive an active balancing weight, not shown, in the form of a flowing medium. A lid 15 is detachably connected to the housing 3.

The housing 3 and a counterweight 4 are seated on freely-rotatable threaded spindles that are axially fixed to the carrier. The threaded spindles 5 have two threaded regions 6, 7 that work in opposite directions with respect to one another, each of the threaded regions extending essentially over one-half the length of the threaded spindles 5. The threaded region 6 cooperates with the housing 3, and the threaded region 7 cooperates with the counterweight 4. When the threaded spindles 5 are rotated, the distance between the housing 3 and an axis of rotation R of the mixing device changes, as does the distance between the housing 3 and the counterweight 4. This means that, depending on the direction of rotation of the threaded spindles 5, the housing 3 and the counterweight 4 are moved toward or away from one another. Four parallel threaded spindles 5, which are essentially disposed in the peripheral region of the housing 3 and the counterweight 4, serve to displace the housing 3 and the counterweight 4.

To achieve uniform rotation of all of the threaded spindles 5, the threaded spindles 5 each have a drive wheel 9 in the center of the carrier 1, the wheel being connected to a transmission element 8 in the form of a toothed belt. If one of the threaded spindles 5 is rotated, the remaining three threaded spindles 5 simultaneously co-rotate.

The mixing device is conceptualized to be permanently in a balanced state.

The center of gravity of all masses that results on the balancing side A of the mixing device is indicated by SA, and the associated radius is indicated by RA. On the mixing side M of the mixing device, the resulting center of gravity of all masses is indicated by SM, and the associated radius is indicated by RM. The two centers of gravity SA, SM lie on a line perpendicular to the axis of rotation R. The products of mass and associated radius RA, RM are identical in amount, both on the balancing side A and the mixing side M.

Figure 2:
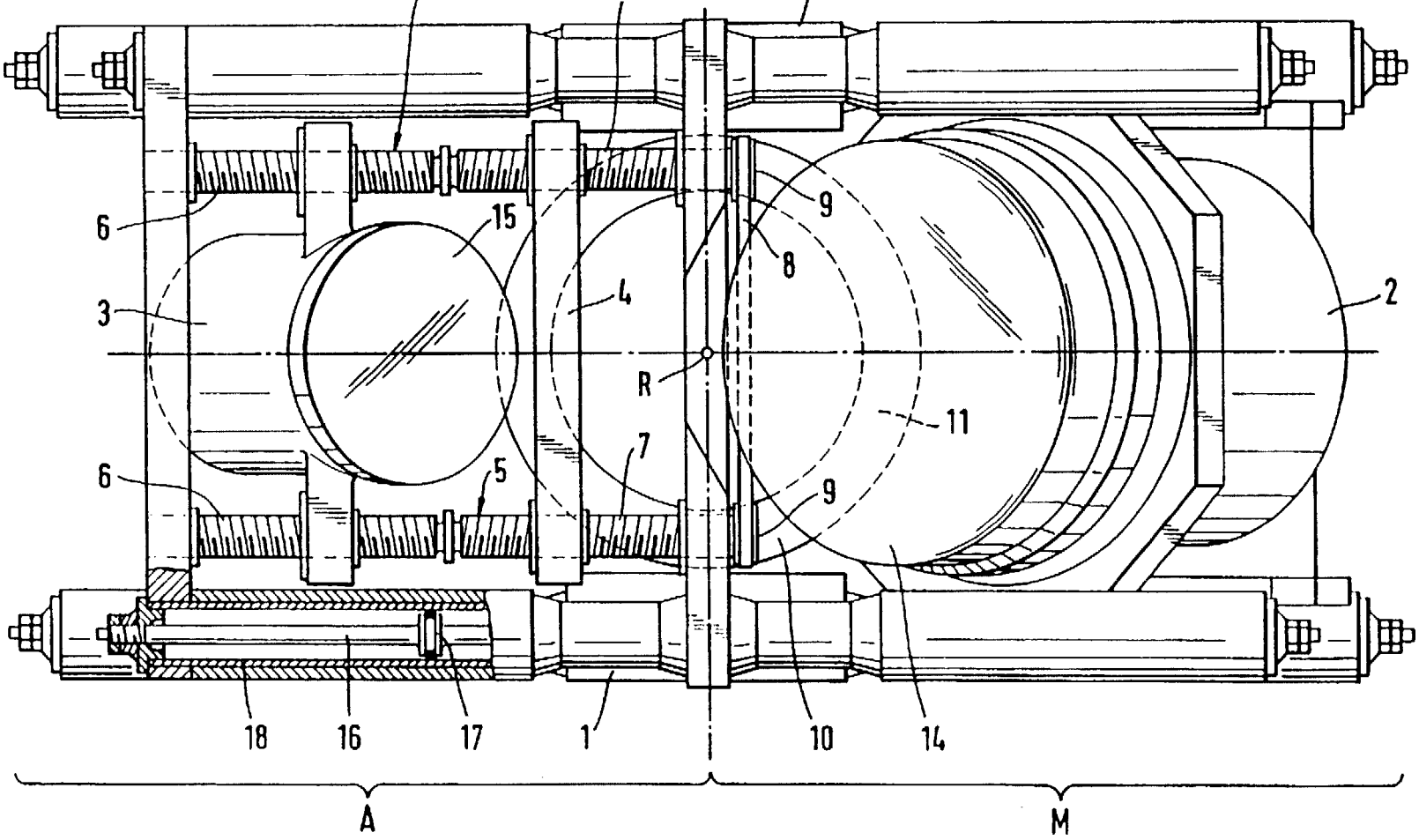
FIG. 2 a plan view, partially in section, of the mixing device according to FIG. 1.

FIG. 2 shows, in a region of the carrier 1 partially in section, a towing bar 16 supported radially by way of bearing elements 17 on a bearing shell 18 disposed in the carrier 1. The towing bar 16 has expansion regions that permit the towing bar 16 to be displaced under a prestress. The carrier 1 has four parallel towing bars 16, which permit all of the parts of the carrier 1 to be held together, even at a high rotating speed.

Figure 3:
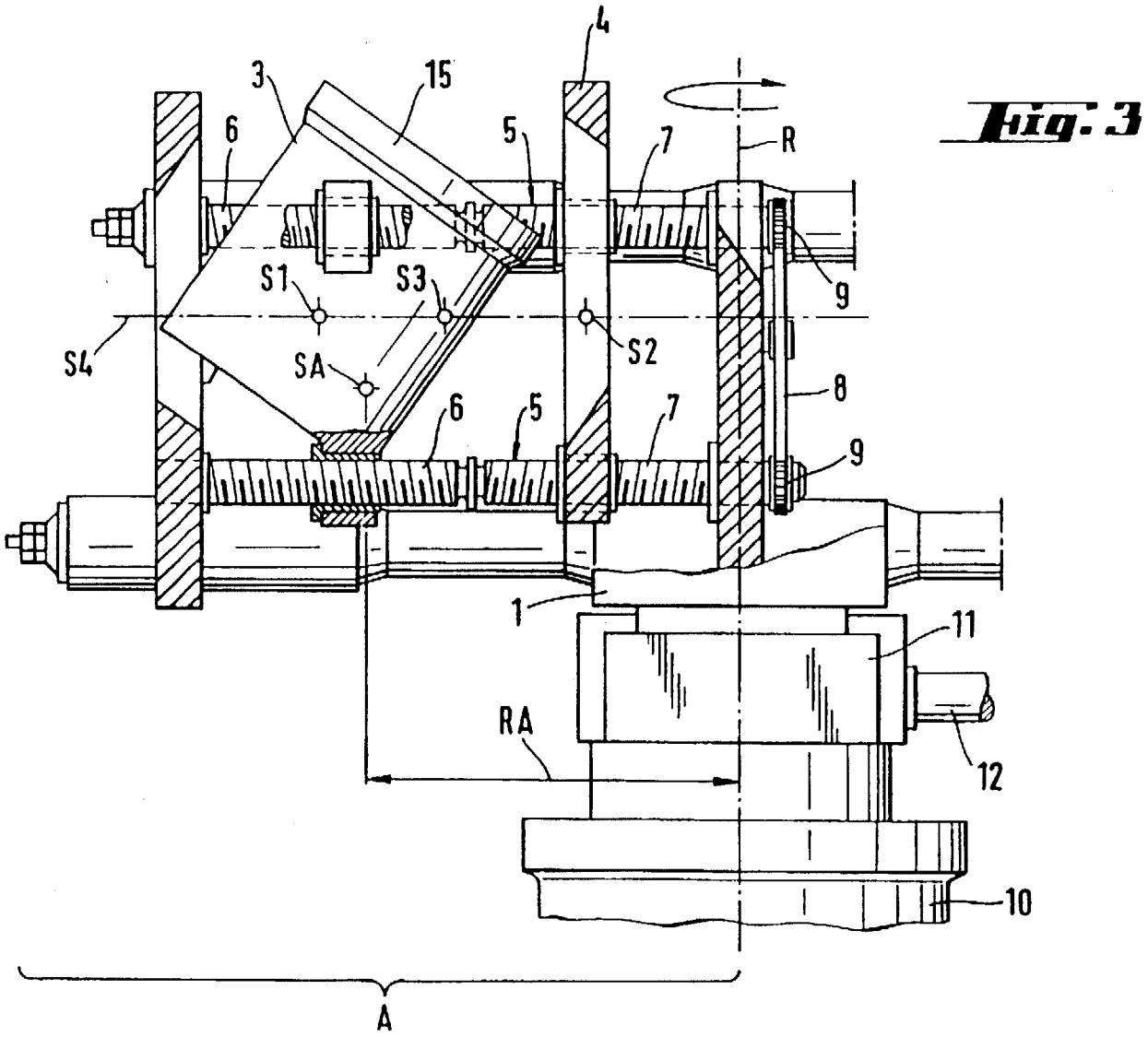
FIG. 3 a sectional representation of the balancing side of the mixing device according to FIGS. 1 and 2.

The balancing side A of the mixing device shown in FIG. 3 includes the housing 3 seated on the threaded spindles 5, and the counterweight 4, with the empty housing 3 and the counterweight 4 having identical weights and centers of gravity. The housing 3 has a center of gravity S1, and the counterweight 4 has a center of gravity S2. The two centers of gravity S1, S2 lie on a common beam S4, which extends perpendicular to the axis of rotation R. The common center of gravity of the housing 3 and the counterweight 4 is indicated by S3, and lies between the centers of gravity S1, S2 on the common beam S4. If it is necessary to displace the housing 3 radially with respect to the axis of rotation R due to free-flowing masses (not shown) that differ in degree of mixing difficulty, this effects a change in the position of the center of gravity S1 of the housing 3 on the common beam S4. At the same time, however, the center of gravity S2 of the counterweight 4 changes in the opposite direction. Regardless of whether the housing 3 and the counterweight 4 are now moved toward or away from one another, the common center of gravity S3 always remains at the same location on the common beam S4.

We claim:

1. A mixing device for mixing free flowing masses in a container, the mixing device having a rotational axis and comprising:

a rotating carrier defining a mixing side, a balancing side disposed opposite the mixing side, and a direction of rotation about the rotational axis of the mixing device;

a container carrier for carrying the container, the container carrier being disposed on the mixing side of the rotating carrier and further being adapted to rotate counter to the direction of rotation of the rotating carrier;

a housing defining a housing center of gravity and being effective as an active balancing weight for the container carrier for balancing moments on the mixing side and on the balancing side;

a counterweight defining a counterweight center of gravity and disposed on the rotating carrier, the counterweight further having a weight matching a tare weight of the housing;

wherein:

the housing and the counterweight are displaceable radially with respect to the rotational axis of the mixing device on the balancing side of the rotating carrier;

the housing center of gravity and the counterweight center of gravity are located on a common line extending perpendicularly with respect to the rotational axis of the rotating carrier; and the counterweight and the housing are displaceable counter to one another by an equal distance.

2. The mixing device according to claim 1, further comprising at least one threaded spindle fixed to the carrier so as to be freely rotatable and having a rotational axis extending radially with respect to the rotational axis of the mixing device, the threaded spindle having:

a first threaded region engaging the housing such that a rotation of the spindle displaces the housing in a first direction; and a second threaded region engaging the counterweight such that the rotation of the spindle displaces the counterweight in a second direction counter to the first direction.

3. The mixing device according to claim 2, wherein the at least one threaded spindle comprises four parallel threaded spindles.

4. The mixing device according to claim 3, further comprising a transmission element connecting the threaded spindles to one another.

* * * * *